US006688908B2

(12) United States Patent
Wallace

(10) Patent No.: US 6,688,908 B2
(45) Date of Patent: Feb. 10, 2004

(54) STACKED DC POWER JACK WITH LED

(75) Inventor: Kenneth Michael Wallace, Sunnyvale, CA (US)

(73) Assignee: Kycon, Incorporated, San Jose, CA (US)

( * ) Notice: Subject to any disclaimer, the term of this patent is extended or adjusted under 35 U.S.C. 154(b) by 0 days.

(21) Appl. No.: 10/044,840

(22) Filed: Jan. 11, 2002

(65) Prior Publication Data

US 2003/0134536 A1 Jul. 17, 2003

(51) Int. Cl.[7] ..... H01R 3/00
(52) U.S. Cl. ..... 439/490; 439/188
(58) Field of Search ..... 439/490, 188, 439/668, 944, 540.1, 541.5; 200/51.1

(56) References Cited

U.S. PATENT DOCUMENTS

| | | | | |
|---|---|---|---|---|
| 3,601,762 | A | | 8/1971 | Eshelman |
| 4,818,239 | A | | 4/1989 | Erk |
| 4,878,856 | A | | 11/1989 | Maxwell |
| 4,900,258 | A | | 2/1990 | Hnatuck et al. |
| 4,978,317 | A | | 12/1990 | Pocrass |
| 5,044,984 | A | | 9/1991 | Mosser et al. |
| 5,080,609 | A | | 1/1992 | Fabian et al. |
| 5,219,294 | A | | 6/1993 | Marsh et al. |
| 5,249,974 | A | | 10/1993 | Wang |
| 5,267,876 | A | | 12/1993 | Rupert et al. |
| 5,318,463 | A | | 6/1994 | Broschard, III et al. |
| 5,591,035 | A | | 1/1997 | Burkholder et al. |
| 5,601,451 | A | * | 2/1997 | Driones et al. ..... 439/490 |
| 5,613,873 | A | | 3/1997 | Bell, Jr. |
| 5,700,157 | A | | 12/1997 | Chung |
| 5,704,802 | A | | 1/1998 | Loudermilk |
| 5,733,143 | A | | 3/1998 | Ward et al. |
| 5,741,152 | A | | 4/1998 | Boutros |
| 5,772,453 | A | | 6/1998 | Tan et al. |
| 5,800,207 | A | | 9/1998 | Hsu et al. |
| 5,876,239 | A | | 3/1999 | Morin et al. |
| 5,876,240 | A | | 3/1999 | Derstine et al. |
| 5,885,100 | A | | 3/1999 | Talend et al. |
| 5,924,889 | A | | 7/1999 | Wang |
| D414,465 | S | | 9/1999 | Hsu et al. |
| 5,975,943 | A | | 11/1999 | Chou et al. |
| 6,027,370 | A | | 2/2000 | Hsu et al. |
| 6,045,401 | A | * | 4/2000 | McAlonis ..... 439/567 |
| 6,074,218 | A | * | 6/2000 | Wu et al. ..... 439/63 |
| 6,077,114 | A | | 6/2000 | Lu |
| 6,116,946 | A | | 9/2000 | Lewis et al. |
| 6,162,078 | A | | 12/2000 | Chung |
| 6,290,538 | B1 | | 9/2001 | Pocrass |
| 6,302,731 | B1 | | 10/2001 | Kring |
| 6,322,397 | B1 | | 11/2001 | Zhang |
| 6,409,530 | B1 | * | 6/2002 | Zhao et al. ..... 439/188 |

* cited by examiner

*Primary Examiner*—Alexander Gilman
(74) *Attorney, Agent, or Firm*—Brinks Hofer Gilson & Lione

(57) ABSTRACT

An electrical connector that includes a housing that has a mounting face with a cavity that is in fluid contact with the ambient environment via an opening formed in a front side of the mounting face and a backplate that abuts a rear side of the mounting face. A contact, wherein a portion of the contact is positioned within the cavity. A compression rod that engages the mounting face and the backplate in a compressive manner towards one another.

10 Claims, 5 Drawing Sheets

28
106
82
80
104
76
26
84
74
78
22
62
66
60
71
59
48
52
34
30
50
102
40
68
30
46
94
24
44
38
36
32
70
98
107
20
72
93
74
91
91
74
93
71

STACKED DC POWER JACK WITH LED

BACKGROUND OF THE INVENTION

1. Field of the Invention

The present invention relates to the field of electrical connectors, in particular power jacks.

2. Discussion of Related Art

Electrical connectors with light indicators are well known in the art as evidenced by U.S. Pat. Nos. 5,876,239 and 5,876,240, the entire contents of each are hereby incorporated herein by reference. In such electrical connectors, the attachment of the light indicator to the housing often is complicated.

It is also known to have electrical connectors and associated indicators, such as LED's, that are separate from one another. In such a case, there is an increase in defects and manufacturing costs when the indicators are separate from the electrical connector. In particular, added costs result from buying the components independent of one another. In addition, the separate indicators take up additional room on the PC board to which they are connected. Furthermore, separate indicators make it difficult to locate the indicators above an electrical connector, such as a DC power jack.

SUMMARY OF THE INVENTION

One aspect of the present invention regards an electrical connector that includes a housing that has a mounting face with a cavity that is in fluid contact with the ambient environment via an opening formed in a front side of the mounting face and a backplate that abuts a rear side of the mounting face. A contact, wherein a portion of the contact is positioned within the cavity. A compression rod that engages the mounting face and the backplate in a compressive manner towards one another.

The above aspect of the present invention provides the advantage of a simple way of constructing an electrical connector, such as a power jack.

The above aspect of the present invention provides the additional advantage of saving space in electrical connectors.

The above aspect of the present invention provides the advantage of simplifying the mounting of indicators associated with an electrical connector.

The above aspect of the present invention provides the advantage of reducing manufacturing costs and defects by allowing an electrical connector and associated indicator to be purchased integrally with one another.

The above aspect of the present invention provides the additional advantage of reducing the amount of room traditionally taken up by an electrical connector and separate indicator on a PC board to which they are connected. In particular, the present invention allows an electrical connector to be integral with an indicator without increasing the footprint of the electrical connector.

The present invention, together with attendant objects and advantages, will be best understood with reference to the detailed description below in connection with the attached drawings.

DETAILED DESCRIPTION OF THE INVENTION

Figure 1:
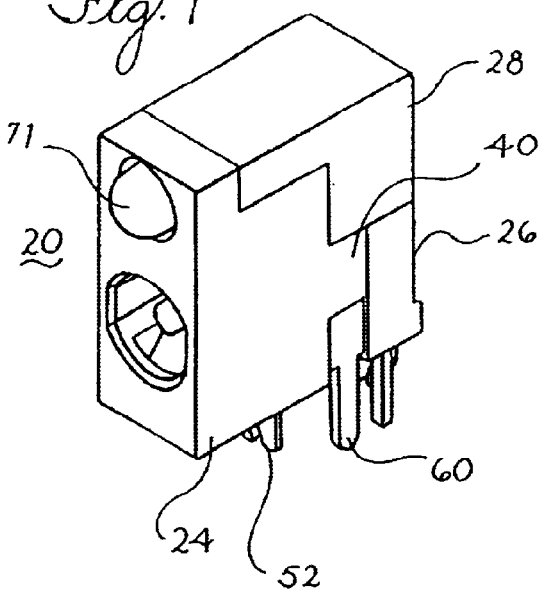
FIG. 1 is a front elevational perspective view of an embodiment of an electrical connector according to the present invention.

Referring to the drawings, FIGS. 1–17 show an embodiment of an electrical connector, such as the stacked dc power jack 20. As shown in FIGS. 3, 8, 10 and 11, the power jack 20 includes a housing 22 that includes three separate components: a mounting face 24, a backplate 26 and a top cover 28.

Figure 2:
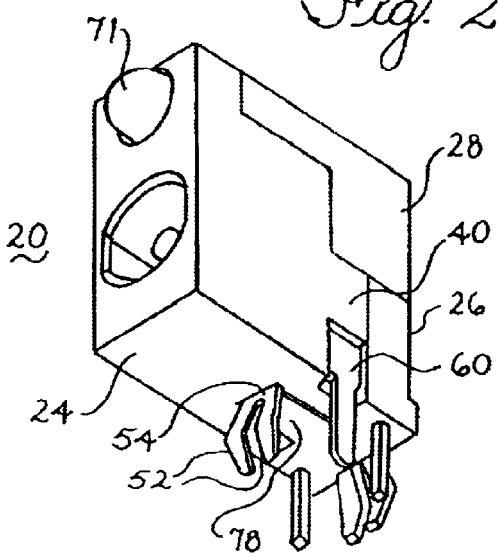
FIG. 2 is a bottom perspective view of the electrical connector of FIG. 1.
Figure 3:
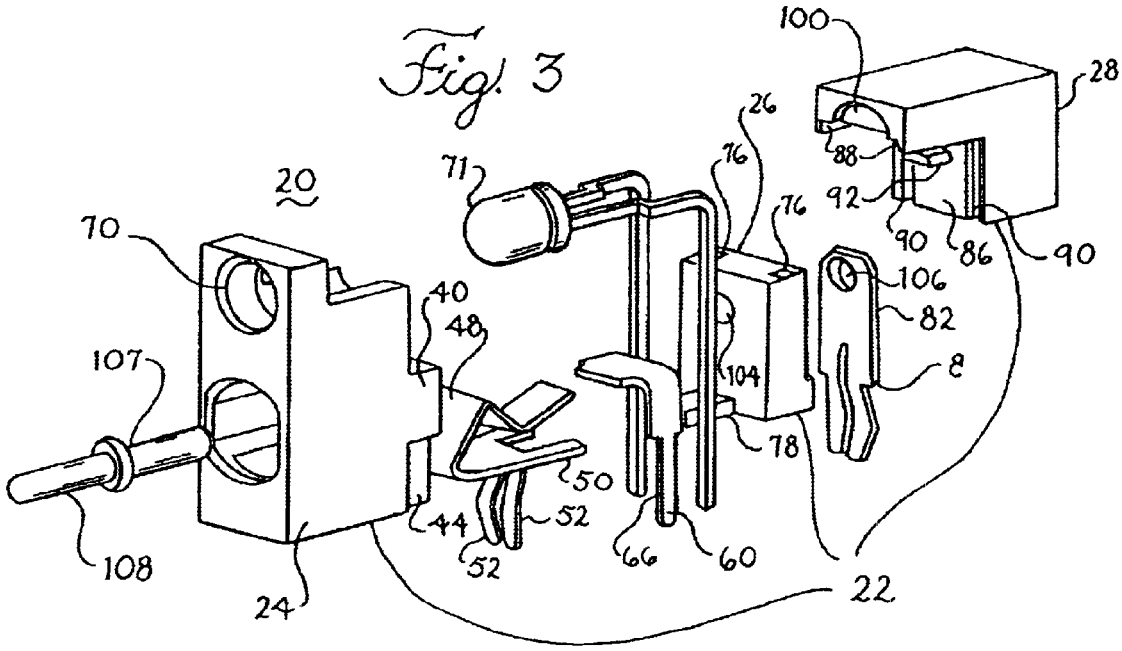
FIG. 3 is an exploded perspective view of the electrical connector of FIG. 1.
Figure 4:
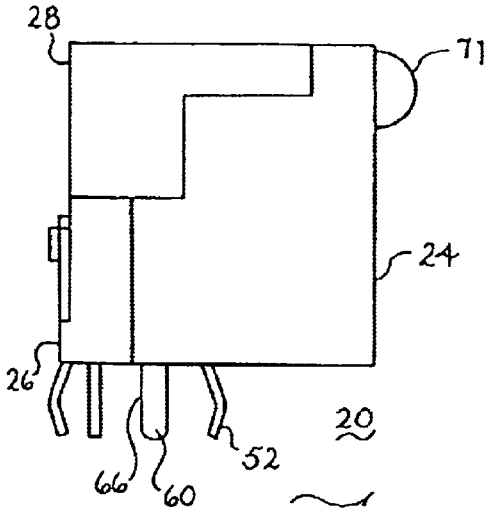
FIG. 4 is a right side view of the electrical connector of FIG. 1.
Figure 5:
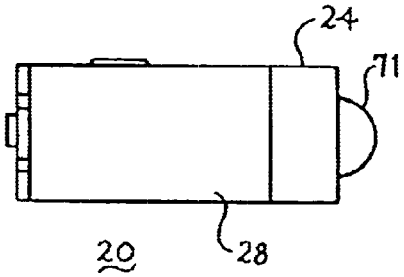
FIG. 5 is a top view of the electrical connector of FIG. 1.
Figure 6:
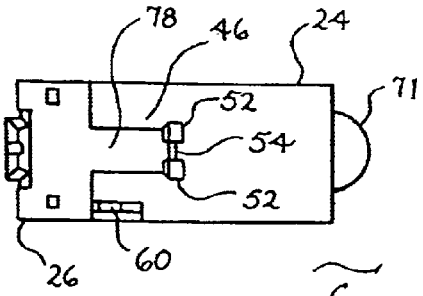
FIG. 6 is a bottom view of the electrical connector of FIG. 1.
Figure 7:
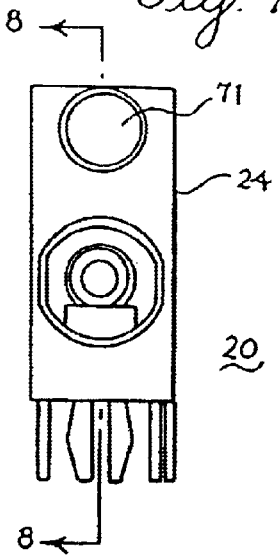
FIG. 7 is a front view of the electrical connector of FIG. 1.
Figures 9, 10:
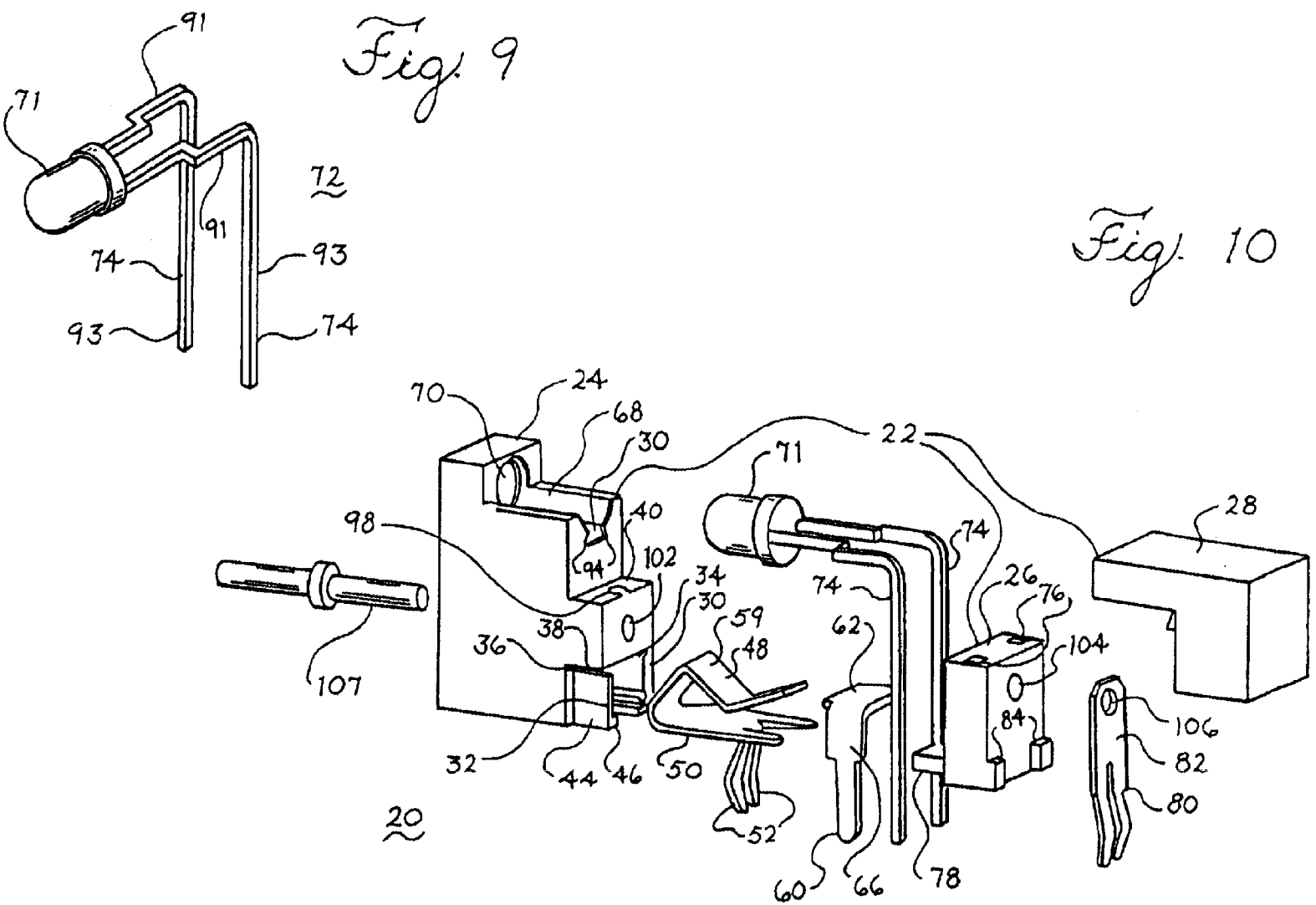
FIG. 9 is perspective view of an embodiment of a visual indicator to be used with the electrical connector of FIG. 1 according to the present invention.
FIG. 10 is an exploded left side perspective view of the electrical connector of FIG. 1.
Figure 11:
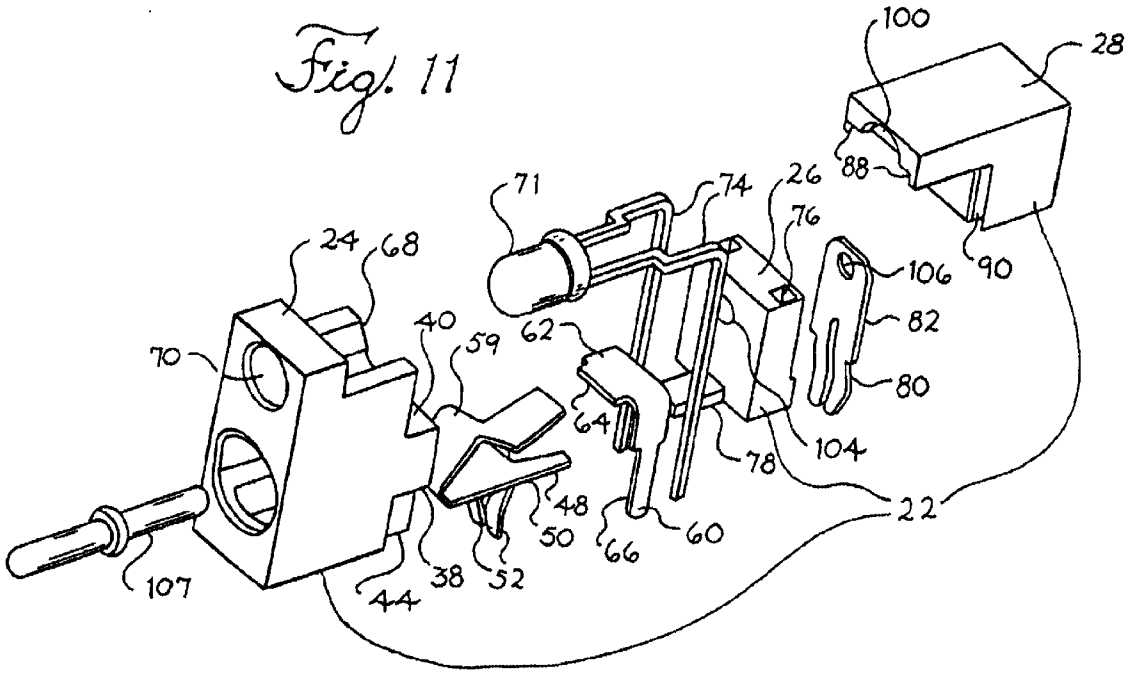
FIG. 11 is an exploded top perspective view of the electrical connector of FIG. 1.
Figure 12:
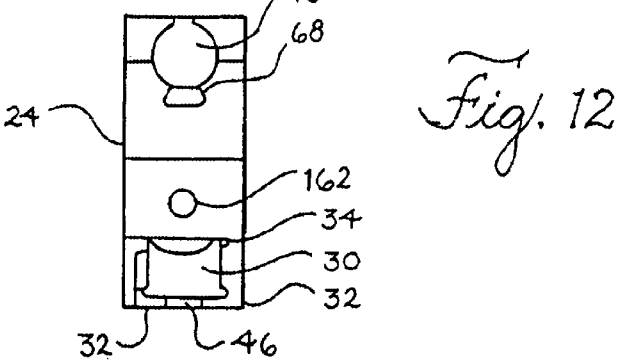
FIG. 12 is a rear view of an embodiment of a mounting face to be used with the electrical connector of FIG. 1.
Figure 13:
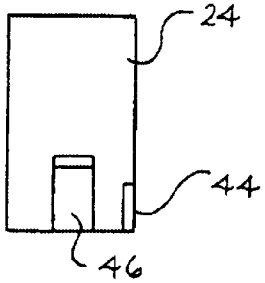
FIG. 13 is a bottom view of the mounting face of FIG. 12.
Figure 14:
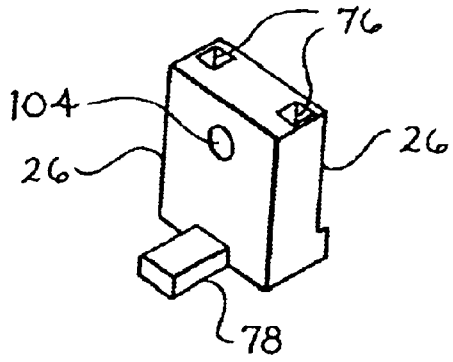
FIG. 14 is a perspective view of an embodiment of a backplate to be used with the electrical connector of FIG. 1.
Figure 15:
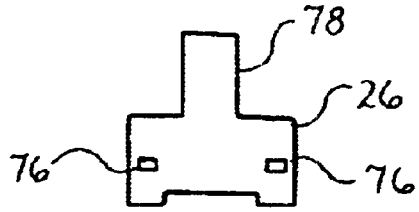
FIG. 15 is a bottom view of the backplate of FIG. 14.
Figure 16:
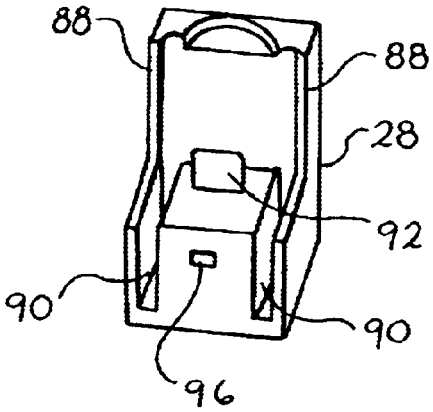
FIG. 16 is a bottom perspective view of an embodiment of a top cover to be used with the electrical connector of FIG. 1.
Figure 17:
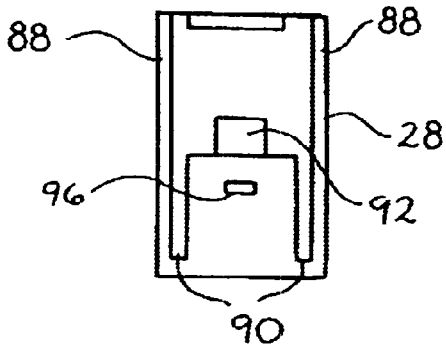
FIG. 17 is a bottom view of the top cover of FIG. 16.

The mounting face 24 includes a bottom channel 30 that has a substantially rectangular cross-section. As shown in FIGS. 10 and 12, the bottom corners of channel 30 have grooves 32 formed therein. A top, right corner of the channel 30 has a groove 34. A portion of the top, left corner of the channel 30 has a slot 36 formed between a bottom surface 38 of a rear extension 40 of the mounting face 24 and a top surface 42 of an indented section 44. In addition, a rectangular cutout 46 is formed at the bottom and rear of the channel 30 as shown in FIGS. 10, 12 and 13. With the channel 30 so formed, a spring contact 48 is inserted into the channel 30, where the bottom, side edges 50 of the spring contact 48 are slid into the grooves 32. During insertion of the spring contact 48 into the channel 30, two downwardly extending leads 52 enter and extend through the cutout 46. When the spring contact 48 is fully inserted within the channel 30, the leads 52 abut a forward edge 54 that defines a closed end of the cutout 46, as shown in FIG. 2.

Figure 8:
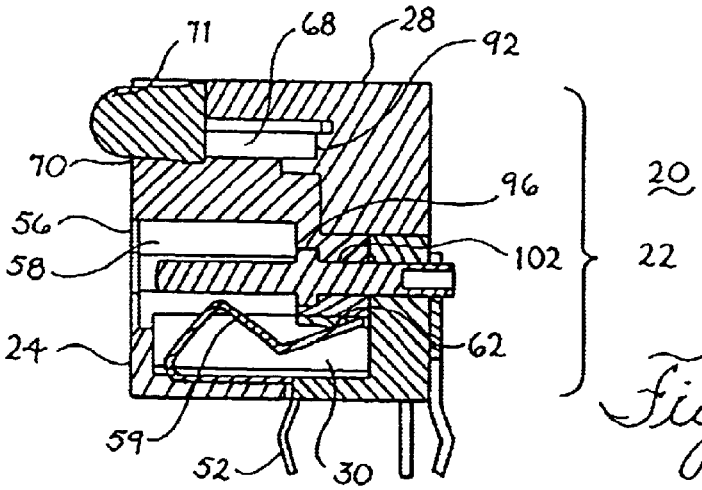
FIG. 8 is a side cross-sectional view of the electrical connector of FIG. 1 taken along line 8—8 of FIG. 7.

As shown in FIG. 8, a front end of the channel 30 is connected to a cavity 56 that is exposed to the outside environment via a circular opening 58 formed in the front of the mounting face 24. An inverted V-shaped portion 59 of the spring contact 48 is positioned within the cavity 56. It is possible that more than one spring contact is placed within the cavity 56.

As shown in FIGS. 1–4, 6, 10 and 11, a third downwardly extending lead 60 is attached to the mounting face 24. The lead 60 is a shunt terminal that creates a normally closed internal switch inside the power jack 20. For certain uses of the power jack 20, the lead 60 can be removed. The lead 60 is L-shaped where a horizontal leg 62 has an edge 64 inserted into the groove 34. The horizontal leg 62 extends through the slot 36 so that a vertical leg 66 is placed adjacent to the indented section 44. Once attached to the mounting face 24, the horizontal leg 62 lies above the spring contact 48 and has a portion that contacts the spring contact 48 as shown in FIG. 8.

As shown in FIGS. 8 and 10–12, a top recess 68 is formed in the mounting face 24. The top recess 68 is aligned with a top circular opening 70. A plastic cover 71 of a visual indicator 72 is inserted past the top recess 68 and inserted into the top circular opening 70. A single or bi-color light emitting diode (LED) is contained within the cover 71 and are in parallel with one another and are connected to leads 74. In the case of a bi-color LED, the colors may be blue and amber. In addition, the lead 60 is used when the bi-color LED is used. The leads 74 extend downwardly and are inserted into corresponding holes 76 formed in the backplate 26.

The backplate 26 is positioned adjacent to the rear extension 40 and is riveted to the mounting face 24. Upon attachment of the backplate 26 to the mounting face 24, a tongue 78 of the backplate 26 is inserted into the cutout 46 so as to form a flush bottom surface. In addition, a bottom edge 80 of a rear contact 82 is inserted into grooves 84 formed at the rear of the backplate 26.

The top cover 28 has an L-shaped inner surface 86 that includes a pair of horizontal grooves 88 and a pair of vertical grooves 90. The horizontal portions 91 of the leads 74 are inserted into the horizontal grooves 88 and the vertical portions 93 of the leads 74 are inserted into the vertical grooves 90. The grooves 88 and 90 thus align the leads 74 at a 90° downward bend. The top cover 28 further includes a guide pin 92 that is inserted into the top recess 68 so that edges of the guide pin 92 are inserted into grooves 94 of the top recess 68. The guide pin 92 prevents the top cover 28 from moving up or to either side. The top cover 28 further includes a locking tab 96 that is inserted into slot 98 formed in the rear extension 40. The locking tab 96 prevents the top cover 28 from sliding backwards. Once the locking tab 96 is inserted into slot 98, a top and rear portion of the cover 71 of the visual indicator 72 is inserted into a semi-circular-like recess 100 formed in the top cover 28.

Note that attachment of the backplate 26 to the mounting face 24 also results in the alignment of the circular openings 102, 104 and 106 of the mounting face 24, backplate 26 and rear contact 82, respectively. As shown in FIG. 8, the opening 102 is in fluid communication with the cavity 56. The aligned openings 102, 104 and 106 allow a rear portion 107 of rod 108 to be inserted therein. An annular collar 109 of the rod 108 snugly engages a front recess of the opening 102, thus limiting the amount of rod 108 that passes rearwardly of the front recess of the opening 102. Once the annular collar 109 engages the front recess of the opening 102, the rear end of the rod 108 extends past the opening 106. At this position, the rear end is bent back and riveted to the rear of the rear contact 82. Such riveting compresses the contact 82, backplate 26 and mounting face 24 against one another.

As shown in FIGS. 1–9, the power jack 20 has seven leads/contacts that protrude from the power jack 20 and are to be installed onto a printed circuit board (not shown). Once the power jack 20 is installed to the printed circuit board, a plug can be inserted into the cavity 56 containing the rod 108. Once the plug contacts the rod 108, electrical power and/or signals are transferred from the plug to the rod 108 and PC board and vice versa. During the transfer of electrical power and/or signals, the single or bi-color LED of the visual indicator is illuminated so as to signal to the user that at that moment a change in system status, via a transfer of electrical power and/or signals, is occurring. For example, the illumination of the single or bi-color LED can be used to indicate the level of voltage that is being supplied to the PC board via the rod 108 where one color indicates one voltage level and another color indicates another voltage level. Another possibility is for one of the bi-color LED's to be lit indicating battery power is being used by the system while the other bi-color LED is lit when DC power is being used by the system.

The foregoing description is provided to illustrate the invention, and is not to be construed as a limitation. Numerous additions, substitutions and other changes can be made to the invention without departing from its scope as set forth in the appended claims.

I claim:

1. An electrical connector comprising:

a housing comprising:

a mounting face with a cavity that is in fluid contact with the ambient environment via an opening formed in a front side of said mounting face; and a backplate that abuts a rear side of said mounting face; and a contact, wherein a portion of said contact is positioned within said cavity;

a compression rod that engages said mounting face and said backplate in a compressive manner towards one another, wherein said rod is inserted into a hole formed in said mounting face and a hole formed in said backplate and said rod is riveted so as to compressively attach said mounting face and backplate to one another; and wherein said contact makes contact with said rod.

2. The electrical connector of claim 1, wherein said contact has a shape of an inverted V and an apex of said V contacts said rod.

3. An electrical connector comprising:

a housing comprising:

a mounting face with a cavity that is in fluid contact with the ambient environment via an opening formed in a front side of said mounting face; and a backplate that abuts a rear side of said mounting face; and a contact, wherein a portion of said contact is positioned within said cavity;

a compression rod that engages said mounting face and said backplate in a compressive manner towards one another; and an L-shaped lead that is attached to said mounting face, wherein said L-shaped lead comprises:

a horizontal leg that is inserted into a groove of said mounting face; and a vertical leg that extends past said mounting face, wherein a portion of said vertical leg is positioned within an indented section of said mounting face.

4. An electrical connector comprising:

a housing comprising:

a mounting face with a cavity that is in fluid contact with the ambient environment via an opening formed in a front side of said mounting face; and a backplate that abuts a rear side of said mounting face; and a contact, wherein a portion of said contact is positioned within said cavity;

a compression rod that engages said mounting face and said backplate in a compressive manner towards one another; and an L-shaped lead that is attached to said mounting face, wherein said L-shaped lead comprises:

a horizontal leg that is inserted into a groove of said mounting face, wherein said horizontal leg lies above said contact and has a portion that contacts said contact; and a vertical leg that extends past said mounting face.

5. An electrical connector comprising:

a housing comprising:

a mounting face with a cavity that is in fluid contact with the ambient environment via an opening formed in a front side of said mounting face;

a top cover; and a backplate that abuts a rear side of said mounting face; and a contact, wherein a portion of said contact is positioned within said cavity; and a compression rod that engages said mounting face and said backplate in a compressive manner towards one another;

a visual indicator that is attached to said backplate, wherein said visual indicator comprises a first lead and a second lead that extend through corresponding openings formed in said backplate wherein said top cover overlies said visual indicator.

6. The electrical connector of claim 5, wherein said top cover comprises a groove into which portions of said first lead are inserted.

7. The electrical connector claim 5, wherein one of said top cover and said mounting face comprises a groove and the other one of said top cover and said mounting face comprises a guide pin that is inserted into said groove.

8. The electrical connector of claim 7, wherein one of said top cover and said mounting face comprises a slot and the other of said top cover and said mounting face comprises a tab that is inserted in said slot.

9. An electrical connector comprising:

a housing comprising:

a mounting face defining a receiving hole and an opening, and a top cover assembled on said mounting face, said top cover comprising:

a horizontal portion comprising a groove; and a vertical portion;

a contact assembled in said housing for transmitting current wherein said contact has a shape of an inverted V;

a rod positioned in said opening, wherein an apex of said V contacts said rod; and a visual indicator received in said receiving hole of said mounting face, said visual indicator comprises a lead, wherein a portion of said lead is inserted into said groove.

10. An electrical connector comprising:

a housing comprising:

a mounting face defining a receiving hole and an opening, and a top cover assembled on said mounting face, wherein one of said top cover and said mounting face comprises a groove and the other one of said top cover and said mounting face comprises a guide element that is inserted into said groove; and a visual indicator received in said receiving hole of said mounting facet;

a contact assembled in said housing for transmitting current wherein said contact has a shape of an inverted V; and a rod positioned in said opening, wherein an apex of said V contacts said rod.

* * * * *

UNITED STATES PATENT AND TRADEMARK OFFICE

CERTIFICATE OF CORRECTION

PATENT NO. : 6,688,908 B2
DATED : February 10, 2004
INVENTOR(S) : Kenneth M. Wallace It is certified that error appears in the above-identified patent and that said Letters Patent is hereby corrected as shown below:

Column 6,
Line 35, delete “facet;” and substitute -- face; -- in its place.

Signed and Sealed this

Twenty-second Day of February, 2005

JON W. DUDAS
*Director of the United States Patent and Trademark Office*